US005242080A

United States Patent [19]

Kroon et al.

[11] Patent Number: 5,242,080

[45] Date of Patent: Sep. 7, 1993

[54] APPARATUS FOR TEMPORARILY STORING ARTICLES AND FOR A NEW DELIVERING SAME

[75] Inventors: Frits Kroon, Harmelen; Hendrik C. Vrind, Deventer, both of Netherlands

[73] Assignee: Machinefabriek "CSW" B.V., Deventer, Netherlands

[21] Appl. No.: 835,945

[22] PCT Filed: Aug. 16, 1990

[86] PCT No.: PCT/NL90/00117

§ 371 Date: Mar. 27, 1992

§ 102(e) Date: Mar. 27, 1992

[87] PCT Pub. No.: WO91/02680

PCT Pub. Date: Mar. 7, 1991

[30] Foreign Application Priority Data

Aug. 17, 1989 [EP] European Pat. Off. ..... 89.202111.4

[51] Int. Cl.[5] ..... B65G 59/00

[52] U.S. Cl. ..... 221/113; 221/119; 221/121; 221/122; 221/133; 221/188

[58] Field of Search ..... 221/122, 121, 119, 188, 221/113, 104, 133, 175, 281, 17, 11

[56] References Cited

U.S. PATENT DOCUMENTS

| | | | |
|---|---|---|---|
| 3,712,506 | 1/1973 | Brownhill | 221/122 X |
| 4,189,259 | 2/1980 | King | 406/63 |
| 4,558,802 | 12/1985 | Molison | 221/122 X |
| 4,989,753 | 2/1991 | Brogna et al. | 221/121 |

FOREIGN PATENT DOCUMENTS

3619519C1 7/1987 Fed. Rep. of Germany .

*Primary Examiner*—David H. Bollinger

*Attorney, Agent, or Firm*—Willian Brinks Olds Hofer Gilson & Lione

[57] ABSTRACT

The invention relates to an apparatus for forming a buffer store of articles, including stackable or restable articles such as cups, plate-or disc-shaped objects, or covers. The apparatus includes supply means for feeding the articles, at least one storage tube for receiving the articles, and discharge means for discharging the articles. The bottom end of the storage tube is selectively connectable to the supply means and the discharge means. Preferably, the storage tube is supported by a pivotable suspension so that it can be swung between a first position proximate to the supply means and a second position proximate to the discharge means.

39 Claims, 6 Drawing Sheets

APPARATUS FOR TEMPORARILY STORING ARTICLES AND FOR A NEW DELIVERING SAME

The invention relates to an apparatus for forming a buffer store of articles, for example stackable or nestable articles such as cups, plate- or disc-shaped objects, which apparatus comprises:

supply means for feeding said articles;

at least one storage tube for receiving a stack of articles; and discharge means for discharging said articles, of which storage tube the bottom end is open and selectively connectable to said supply means and said discharge means respectively;

the storage tube being supported by means of a pivotable suspension such that it can be swung between two positions by means of a first drive means controlled by control means, in the first position of which, the supply position, said tube connects with its open bottom end to the outlet of the supply means and can be filled thereby with articles, and in the second position of which, the discharge position, said tube connects with its open bottom end to the inlet of the discharge means and can deliver articles thereto.

Such an apparatus is known from DE-A-3 619 519.

It is a purpose of the invention to design an apparatus of this type in such a way that it allows the handling not only of cups or tumblers, but rather also covers or other disc-shaped objects.

It is a further purpose of the invention to design an apparatus of this kind such that it is well-adapted to provide a very large buffer capacity and allows supply and discharge of articles at extremely high rates virtually without the risk of interruptions.

An other purpose of the invention is to design an apparatus of this kind such that the construction is very simple and reliable.

To these ends the apparatus according to the invention is characterized by a rotary table which is rotatably drivable stepwise round a vertical rotating axis by second drive means controlled by the control means and which has an upper frame comprising a number of suspensions disposed in a circle and each having a storage tube carried thereby, and a supply opening of the discharge means placed coaxially to the rotating axis of said rotary table, and control means controlling said apparatus such that said storage tubes are placed successively with their open bottom end in register with the outlet of the supply means, and said storage tubes are then successively pivoted radially such that they are carried with their open bottom end into register with the inlet of the discharge means.

The inventive concept can further be explained as follows.

For closing filled containers, for instance cans, with covers, the packaged rows of covers are usually unpacked by a cover unpacking machine and then have to be fed in one continuous flow to the closing device. In order to cause the discontinuous part-flows or rows of covers to join without interruption onto the unbroken flow of covers for feeding to the processing machine special steps are necessary which have the particular object of preventing the danger of the leading and rearmost covers of the flow or parts thereof falling over. This may lead to disturbances in the production process and is therefore very undesirable.

This problem occurs in particular with articles that cannot be stacked or nested easily. An example of this are covers of the easy opening type suitable for closing soft drink cans which comprise a tear-off portion that is bounded by a weakened line and can form a drinking or pouring opening. Such covers are in general either not stackable or hardly so, while moreover, as a result of the asymmetrical form caused by the presence of the pull tab and the small active stacking depth, stable stacking can hardly be accomplished. Such articles therefore have to be permanently transported-in rows such that they are continually subjected to a sufficient axial pressure to prevent particularly the first and last cover of a flow from falling over.

In order to eliminate to a sufficient extent short work interruptions of the cover unpacking machine (and optionally a cover production machine) an adequate buffer capacity has to be made available between the unpacking or production machine and the processing machine. Use could be made of comparatively long conveyor belts. These have the drawback that they occupy much horizontal space and moreover require special steps to prevent articles falling over.

The described apparatus according to the invention can in principle accommodate an unlimited buffer store of articles. It has the further great advantage that through vertical disposition of the storage tube or tubes, use can be made of the force of gravity to keep the articles from tilting, while the horizontal occupation of space can moreover remain very limited. By way of elucidation it is further noted here that in most factories, production halls and the like there is vertical space available, but that the horizontal space is preferably used as little as possible To define the idea more clearly it is observed that a conceivable buffer store for the processing machine can last for roughly three minutes, which can correspond for instance to a number of covers in the order of 9,000.

In order to ensure a certain connection of each storage tube to the inlet of the discharge means the apparatus preferably comprises a registering collar that is up and downwardly movable by the control means round the inlet of the discharge means for holding in position of a storage tube brought into register with the access to the discharge means.

An embodiment displaying the feature that the suspensions are positioned at the same interval from the rotating shaft of the rotary table as the outlet of the supply means has the advantage that the tubes are held in their correct rest position by the force of gravity in order to be filled with articles.

The apparatus according to the invention can be further characterized by a plate having a hole forming the outlet of the supply means, and a hole forming the inlet to the discharge means.

In this case the apparatus can display the particular feature that the bottom end of each storage tube possesses over its entire swing range a small interval to the plate such that at least more or less nestable or stackable articles, such as covers with a pull tab for drink cans for instance, can carry each other along during the swing of the tube, whereby the undermost article slides over the plate.

Particularly in the case of stackable or nestable articles use is preferably made of a separating knife to be driven by the control means for interrupting a flow of articles in the area of transition between the outlet of the supply means and the bottom end of a storage tube in register therewith, after the relevant tube has been filled to a selected height.

The said plate is preferably wear-resistant and smooth, at least in the area in which articles can slide over it.

An embodiment of the invention comprises a pivot driving for pivoting a tube filled to a selected height with articles to the outlet of the discharge means.

In a preferred embodiment the apparatus features spring means, for instance a gas spring, added individually to each tube for constraining each tube radially outward to a pivot position in which the bottom end has the same distance to the rotating shaft as the outlet of the supply means.

Use can hereby advantageously be made of stop means for bounding the radial pivot position of each tube, in which case each tube for filling is always correctly positioned at the location of the supply means.

In order to ensure that during rotation the suspension pivots for radial displacement of the tubes are not loaded tangentially, the embodiment is recommended having the features that the upper frame bears stop wedges extending between the storage tubes in their outermost rest position. The stop wedges serve in this respect as mutual supports between the tubes. The stop wedges can be carried for example by an annular frame part.

A preferred embodiment displays the feature that a guiding connects to the inlet of the discharge means, in which guiding a support for the articles delivered by a storage tube is downward movable such that the stack of articles can catch up with the preceding flow in order to obtain a continuous flow of delivered articles, which support can subsequenty be removed from the path of the articles defined by the guiding.

A mechanically very simple embodiment hereof is one displaying the characteristic that the guiding has an arcuate form and that the support is carried by an arm which is mounted for pivoting concentrically to the guiding.

In order to be certain that the undermost article in a row of articles in a tube for emptying does not risk falling over the apparatus preferably is constructed so that the interval between the support and the top surface of the plate is less than half the smallest diameter of thin articles, so that the undermost article makes without turning the transition form being supported by the plate to being supported by the movable support.

A very simple stepwise rotation of the rotary table is ensured with an apparatus displaying the feature that the second drive means comprise:

an element reciprocally drivable for example by means of a pneumatic or hydraulic cylinder and which hooking at one side can co-act with successive pushing members arranged peripherally on the rotary table in positions corresponding with the suspension, which element has the purpose of carrying the rotary table successively each time into an angled position through operation of the second drive means such that a storage tube can be placed in register with the outlet of the supply means, and controllable locking means for locking in this angled position and releasing therefrom of the rotary table.

An apparatus with a discharge pivot driving can be constructed occupying as little horizontal space as possible in an embodiment with the characteristic that the pivot driving comprises a vertically disposed pneumatic or hydraulic cylinder which can move a drive arm via a lever. In order to cause this drive arm to grip on the respective tubes with the least possible wear and therefore the least possible danger of disturbances the apparatus preferably displays the feature that the active end of the drive arm bears a freely turning roller adapted to the shape of the storage tubes and having specifically a more or less double-cone form.

The apparatus according to the invention can if desired be operated by operatives It is however preferably characterized by sensors, for example photo-electric units or approach switches, which are placed along the path of the articles, are arranged for observing the presence or absence of articles and which partly determine the working of the control means.

A further embodiment of the invention is characterized by a device connected to the supply means for delivering articles, for instance a cover unpacking machine for delivery of covers, which delivery device is part controlled by the control means.

The invention will now be elucidated with reference to the drawing of an embodiment. In the drawing:

FIG. 1 shows a unit 1 with two identical devices 2 according to the invention.

Figure 1:
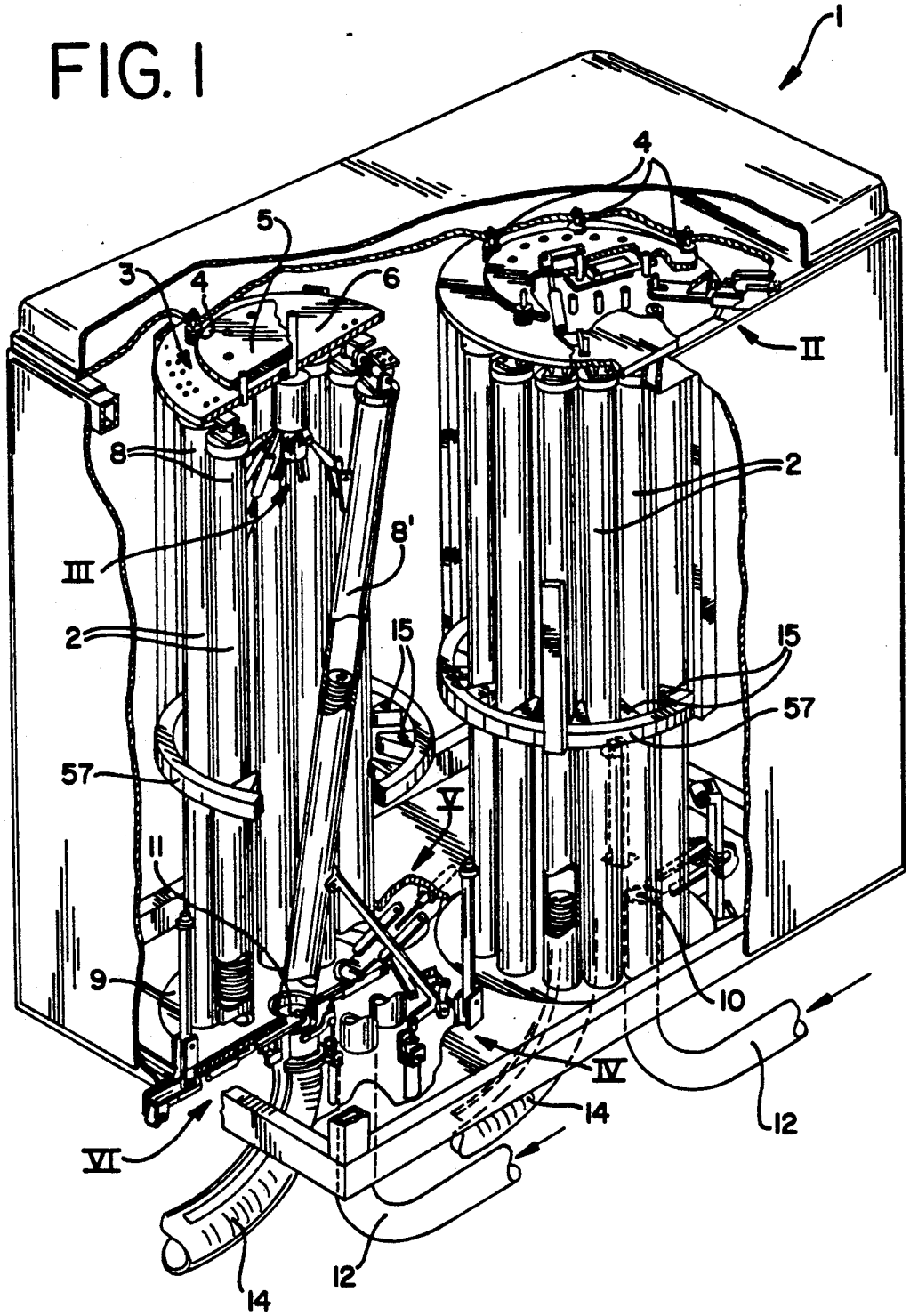
FIG. 1 shows a unit with two devices according to the invention in partially broken away perspective view, both of which devices are drawn for the sake of clarity in mutually differing operating positions and views.

Each of both devices comprises a rotary table 3 rotatably drivable round a vertical rotating shaft by means to be described below, which rotary table is carried by five bearing rollers 4 fixed to the unit 1. The bearing rollers 4 grip on the periphery of a round support disc 5, which disc 5 carries an upper frame plate 6 which carries a number of suspension pivots 7 which are disposed in a circle and which in turn carry storage tubes 8. In this embodiment the storage tubes 8 are made of transparent plastic and are carried by the suspension pivots such that they can only swing in radial direction. The tubes in the rest position located to the outside are designated with 8, while in an emptying position to be further described in which they can deliver articles, they are designated with 8'.

Each apparatus 1 comprises a smooth, wear-resistant base plate 9 which has a supply opening 10 and a discharge opening 11. The supply opening 10 connects to a feed tube 12 for covers 13 to be temporarily stored in the device 2. Connecting to the discharge opening 11 is a discharge pipe 14 which will be further described hereafter.

The feed tube 12 has to be connected to a cover production machine or a cover unpacking machine. Discharge pipe 14 has to be connected to a processing machine for the covers.

The upper frame plate 6 carries a ring 57 which bears a number of wedge-like, slightly flexible stops 15 corresponding with the number of storage tubes 8. These stop wedges 15 define the outermost radial pivot position of the storage tubes 8 and also prevent undesired tangential swinging of the tubes 8 which, particularly when they are full, could load the suspension pivots 7 in undesirable manner.

Figure 2:
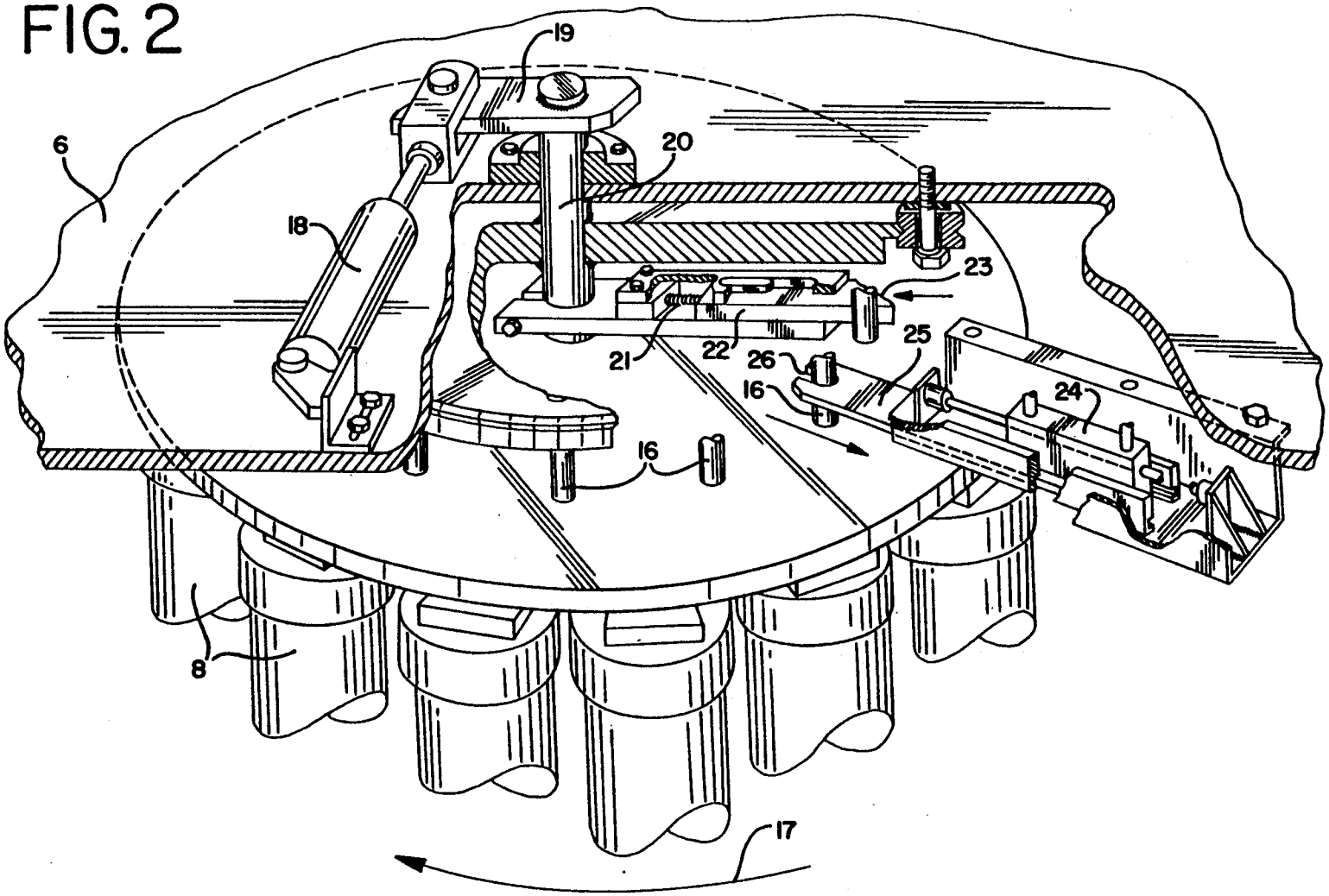
FIG. 2 shows the detail II from FIG. 1 on enlarged scale.

FIG. 2 shows in partly broken away perspective view the manner in which the rotary table 3 can be stepwise driven such that each time a successive tube 8 can be placed with its open bottom end above the supply opening 10.

To this end the upper frame plate 6 bears equidistant pins 16 placed at the same angular distance as the tubes 8, and which can be pressed successively each time to cause the rotary table 3 to rotate in the direction designated with the arrow 17. For this purpose the unit 1 bears a pressure cylinder 18 energizable by undrawn means which can set a drive shaft 20 into rotation through a pre-selected angle of rotation by appropriate energizing via a transmission 19. The drive shaft 20 bears a drive element 22 constrained towards the outside by a pressure spring 21 for co-action with the pins 16, which drive element displays a slanted rise surface 23 which, when the pressure cylinder 18 is energized in the opposite direction, causes the drive element 22 to rotate back and the following pin to move past it by means of the rise surface 23, which pin can then be driven during a subsequent rotation step.

The device 2 further comprises a pressure cylinder 24 for locking in a chosen angled position wherein in the manner described a tube is accurately in register with the supply opening 10. To this end the pressure cylinder 24 bears a locking plate 25 with a securing slot 26 for locking co-action with the pins 16.

It will be apparent that a central control unit (not drawn) has to control the cylinders 18 and 24 such that, in the case cylinder 18 is energized for rotation according to arrow 17, the locking has to be discontinued by appropriate control of the cylinder 24.

Figure 3:
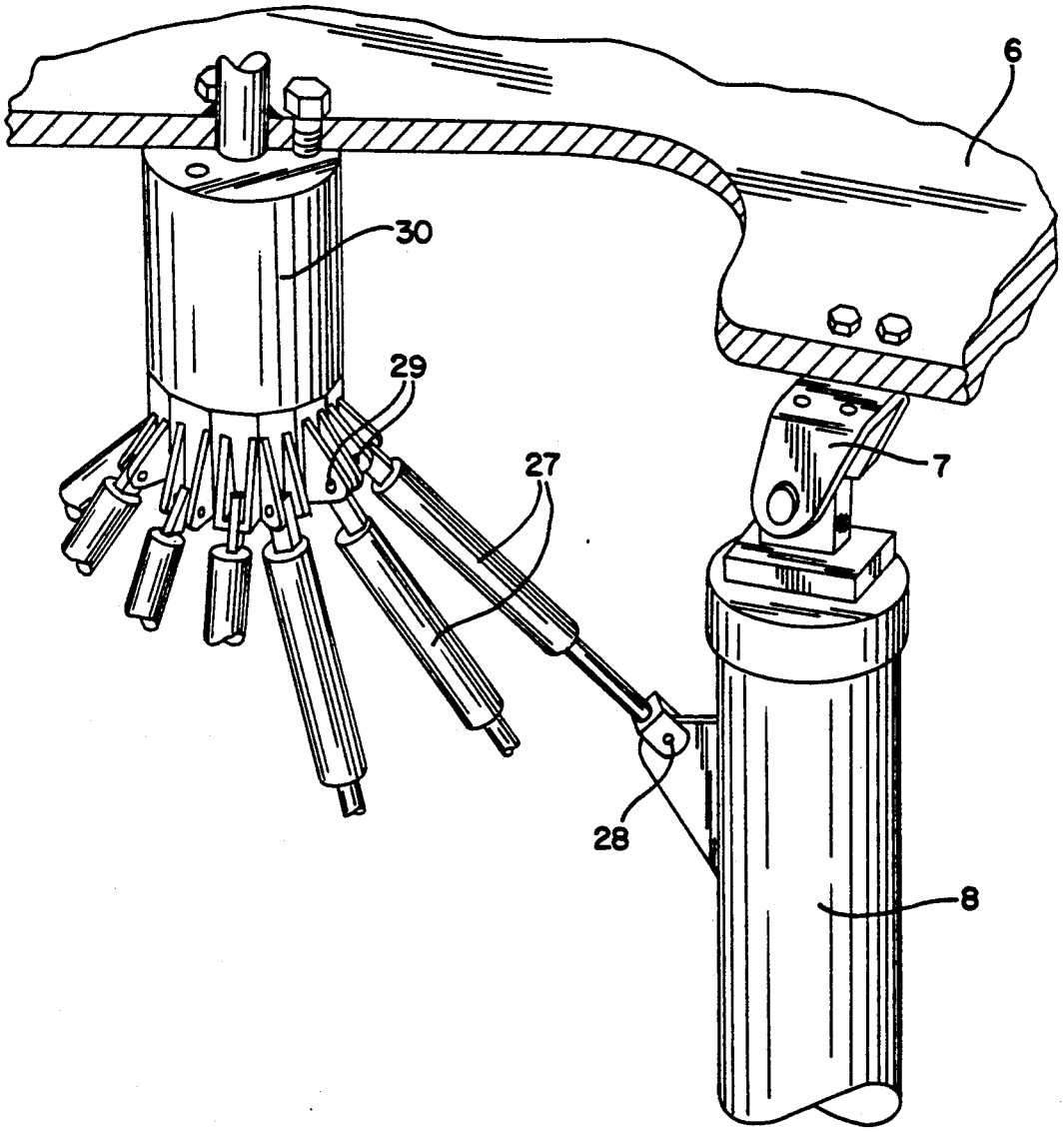
FIG. 3 shows the detail III from FIG. 1 on enlarged scale.

FIG. 3 shows that to each storage tube 8 is added a gas spring 27, these gas springs pressing the tubes radially outward into engagement with the stop wedges 15. On one side the gas springs are joined to the tubes by means of hinges 28 and on the other side they are joined by means of hinges 29 to an attachment block 30 fixed concentrically to the upper frame plate 6.

Figure 4:
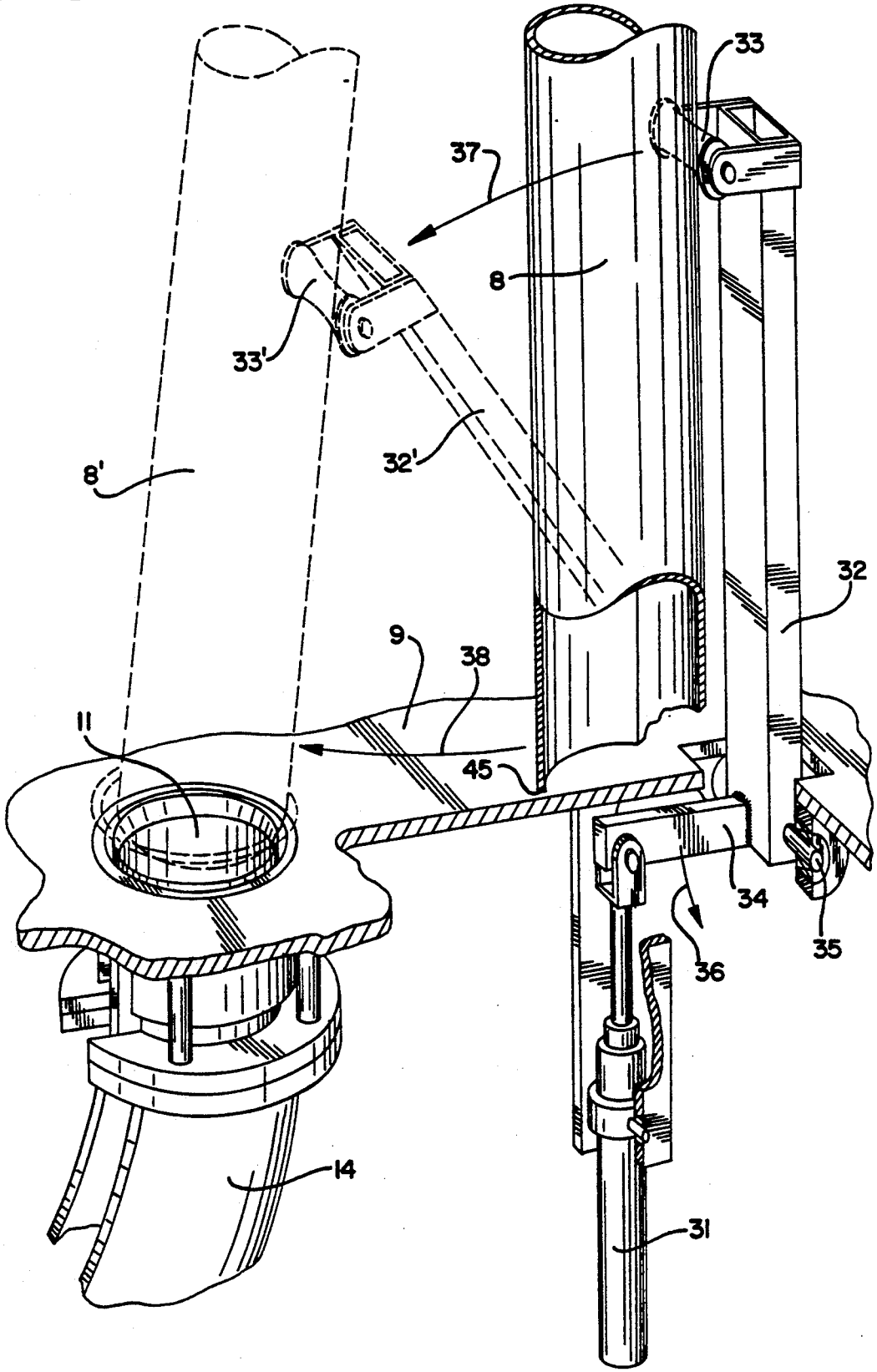
FIG. 4 shows the detail IV from FIG. 1 on enlarged scale.

FIG. 4 shows the manner in which a tube 8 is displaced through the radial swing movement to the position shown in dashed lines and designated 8'. For this purpose the device 2 comprises a vertically disposed pressure cylinder which is drivable by unshown means and which can move a drive arm 32 via a lever 34. The active end of the drive arm 32 bears a free-turning roller 33 with a shape adapted to that of the tubes 8, in this case more or less the shape of a double cone. Through suitable energizing the lever 34 pivots downward round a pivot shaft 35 as according to arrow 36, which results in the roller 33 undergoing a pivoting movement according to arrow 37. This translates itself into a pivoting movement of the tube 8 as according to arrow 38 to the position designated with 8', in which position a tube 8 filled in a manner to be further described hereinafter can deliver its contents to the discharge pipe 14.

Since the discharge opening 11 is placed coaxially to the rotational centre line of the rotary table 3, in the given pivot position 8' of the storage tube 8 this tube can be emptied via the discharge opening 11, irrespective of the angled position of rotary table 3. Such emptying is of course only possible in an angled position where the tube 8 is pivotable by means of the pivot driving 31. 32, 33, 34, 35. For the sake of clarity the position of the arm 32 with roller 33 corresponding to the emptying position 8' is indicated in FIG. 4 with broken lines and designated in this position with 32' and 33' respectively.

Figure 5:
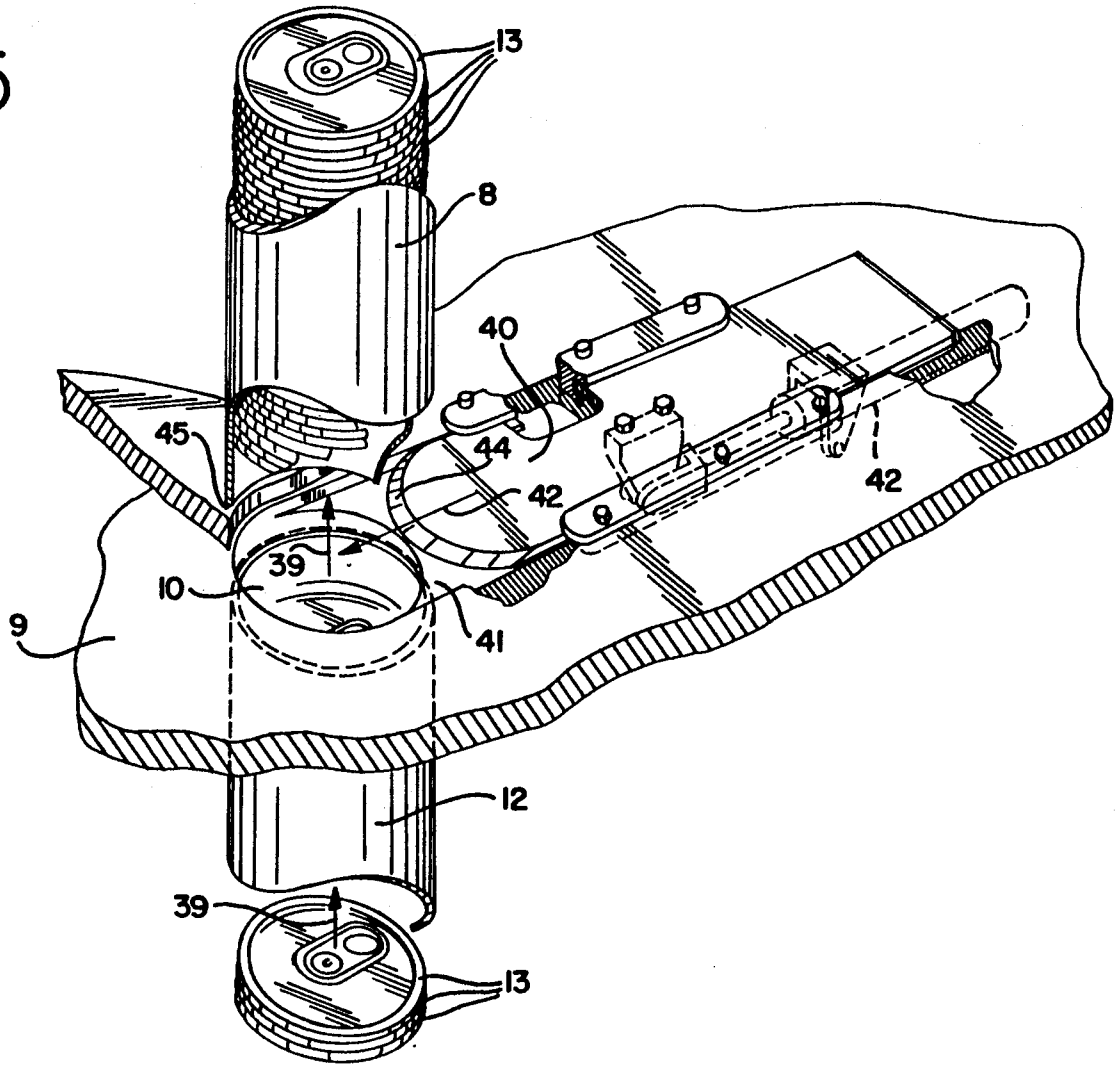
FIG. 5 shows the detail V from FIG. 1 on enlarged scale.

FIG. 5 shows the supply opening 10 of the device 2 in the base plate 9.

The tube 8 is carried by radial pressure from the associated gas spring 27 into a stable position, while the tube is fixed in its angled position by the locking means shown in FIG. 2. A flow of covers 13 is transported upward through the feed pipe 12 via the supply opening 10 into the tube 8 as according to arrow 39, the covers pressing against each other through the effect of the force of gravity. After a pre-selected filling level has been reached, which can be determined by sensors (not drawn) such as approach switches or photo-electric detectors on each tube, the flow is then interrupted by a separating knife 40, the top surface of which coincides with the top surface of the base plate 9, which separating knife 40 is guided for reciprocal sliding in a recessing 41. The separating knife is coupled for this purpose with a pressure cylinder 42 controlled by undrawn means. When a required level of filling of the tube 8 has been reached the pressure cylinder 42 is energized such that the separating knife is moved in the direction of arrow 43, is driven with its tapering forward edge 44 between two covers lying one on the other and through its adapted form subsequently closes off the supply opening 10 and forms together with the upper face of the base plate 9 a smooth surface.

As soon as this step is completed the rotary table 3 can be further displaced through actuation of the rotation driving as in FIG. 2 through a desired number of steps, for instance one, which results in a following tube 8 being carried above the supply opening 10.

Due to the rotation of rotary table 3 the bottom cover 13 slides over the smooth and wear-resistant base plate 9 until the position is reached in which the pivoting means shown in FIG. 4 can become active for the emptying of the tube 8. The distance of the open underside of tube 8 to the base plate 9 is in practice not very important in the case of stackable, or at least to some extent stackable or nestable, articles, since the weight force of the stack of covers 13 results in the undermost covers carrying each other along to an extent sufficient to ensure a reliable operation of the device 2. In the case of non-stackable articles the distance of the free bottom edge 45 of the tube 8 has to be small relative to the upper surface of base plate 9 such that a reliable carrying along of the undermost article is always ensured.

Figure 6:
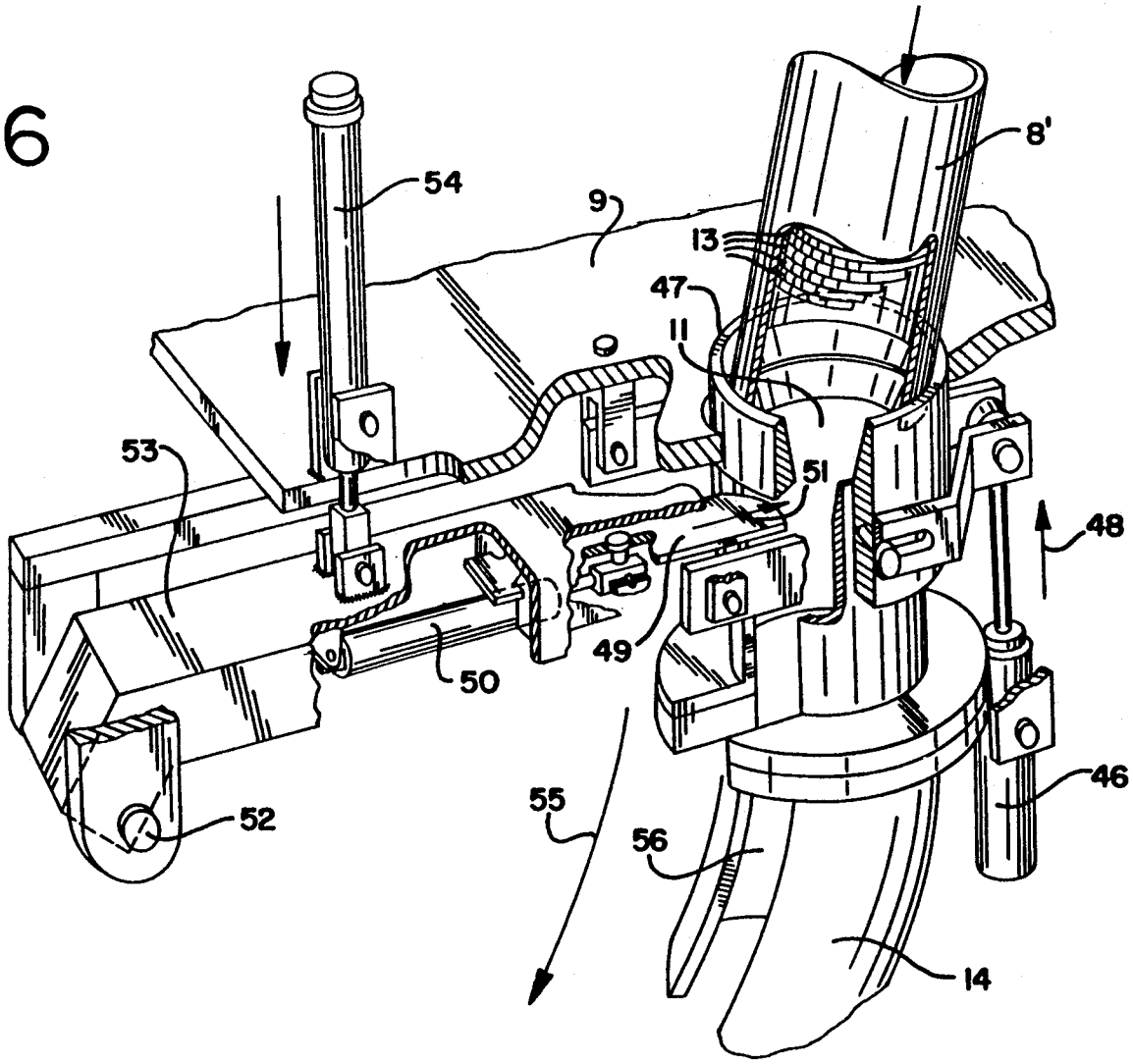
FIG. 6 shows the detail VI from FIG. 1 on enlarged scale.

FIG. 6 shows the manner in which the position 8' of the tubes 8 is secured.

Use is made for this purpose of a pressure cylinder 46 which is drivable by undrawn driving means and which bears a securing collar 47 guided for up and downward movement. This securing collar is carried upward by energizing as according to arrow 48 at the moment a tube 8 has reached the position 8'. As soon as this has been carried out by energizing of the pivot driving as in FIG. 4 the emptying of the tube 8' can take place as required during any random rotation of rotary table 3, since the securing collar 47 ensures correct positioning of the bottom end of tube 8' with respect to discharge opening 11.

FIG. 6 shows a further aspect of the invention. As described above, the emptying of a tube carried into the position 8' can take place at any desired moment and in any desired angled position of the rotary table. In order to be able to control the emptying of tube 8' and to ensure in all circumstances a disturbance-free connection of the stack of covers 13 from the storage tube onto the covers already present in the discharge pipe, the device 2 comprises a support plate 49 which is connected to a pressure cylinder 50 that is controlled by undrawn means and which can move the support plate 49 as according to the arrow 51 into the discharge opening 11 for supporting of the undermost cover 13 of the stack of covers present in tube 8'.

The interval between the upper surface of support plate 49 and the upper surface of base plate 9 is less than half the diameter of the covers, since otherwise there is the danger of the undermost cover tilting.

The pressure cylinder 50 and the support plate 49 are carried pivotably by a pivot shaft 52. FIG. 6 shows the rest position in which the bearing arm 53 for the support plate 49 and the pressure cylinder 50 is located in its highest position. A spring unit 54 loads the arm 53 such that the weight of a stack of covers 13 on the support plate 49 causes a rotation of the arm 53 round the pivot shaft 52 as according to arrow 55. Because the support plate 49 is movable in a slot 56 of the discharge pipe 14 and this discharge pipe 14 is curved in shape, whereby the centre of curvature coincides with the centre line of the pivot shaft 52, the support plate 49 can guide the stack of covers 13 during their fall, which is controlled by the damped spring unit 54, until undrawn sensor means detect that the underside of the support plate 49 has come into contact with the row of covers 13 present in the discharge pipe 14. As soon as this is detected, energizing of the pressure cylinder 50 is performed by the central control means, to which all mentioned pressure cylinders are connected, such that support plate 49 is retracted beyond the path of the covers in the discharge pipe 14 and the arm 53 re-assumes the position shown in FIG. 6. After the passage of the uppermost and therefore last cover of the stack of covers 13 from the tube 8' past the support plate 49 has been observed, the registering of the tube 8' by the collar 47 can also be discontinued. To this end the pressure cylinder 46 is energized by the central control means such that the collar 47 is carried downward counter to the direction of arrow 48. For detecting the passage of the last cover a sensor may be present in the area of the discharge opening 11.

Following the descriptive explanation with respect to the individual controls it will be apparent in which manner the stated control unit (not drawn) can operate.

Prior to first setting into operation the device 2 a flexible plug can be initially arranged in the discharge pipe 14 which can ensure that the first arriving cover 13 is collected such that it cannot fall over. The plug can be removed at the moment when the row of covers in the discharge pipe 14 has reached a "safe" place in the processing machine connected thereto. What is understood by a safe place in this context is a place where the covers are no longer subjected to tilting forces, when for instance they are being guided upward and as a result press against each other under the influence of the force of gravity.

The base plate 9 and the separating knife 40 can consist of aluminium to which is applied a hard-chrome layer of for instance 10 $\mu$m thickness in order to ensure smoothness and wear-resistance. The upper surfaces may also be anodized.

The shape of the forward edge 44 of the separating knife 40 is selected such that covers provided with a flanging edge can be separated reliably without the separating knife being able to damage the covers concerned.

The mentioned pressure cylinders will generally be of the pneumatic type, since pneumatic devices generally operate rapidly and are inexpensive.

It will be apparent that the apparatus described is only an example and that many modifications are possible within the scope of the claims. The embodiment described is however specially designed with a view to achieving a desired large buffer capacity with a small occupation of horizontal space.

We claim:

1. An apparatus for forming a buffer store of stackable articles comprising:
   - a feeder having an outlet to feed articles;
   - a discharger having an inlet to receive articles;
   - a storage tube for storing a stack of articles, the storage tube connected to a table, the table rotatable about a first axis of rotation, the storage tube having a first end, the storage tube movable between a first position, in which the first end of the storage tube is connectable to the outlet of the feeder to fill the storage tube with articles fed from the feeder, and a second position, in which the first end of the storage tube is connectable to the inlet of the discharger to deliver articles from the storage tube to the discharger;
   - a first device to rotate the table;
   - a second device to move the storage tube between the first position and the second position; and
   - a controller to control the movement of the storage tube;
   - wherein the inlet of the discharger is coaxial to the first axis of rotation and the outlet of the feeder is placed at a distance from the first axis of rotation.

2. The apparatus of claim 1 wherein the table is rotatable in a stepwise manner.

3. The apparatus of claim 1 wherein the first end of the storage tube is open.

4. The apparatus of claim 1 further comprising a securing collar for maintaining the first end of the storage tube in connection with the inlet of the discharger.

5. The apparatus of claim 1 further comprising a suspension to connect the storage tube to the table, the suspension positioned at a distance from the first axis of rotation.

6. The apparatus of claim 1 further comprising a plate having a first hole forming the outlet of the feeder, and a second hole forming the inlet to the discharger.

7. The apparatus of claim 1 further comprising a separating knife movable between a first position, in which the separating knife interrupts the flow of articles between the first end of the storage tube and the outlet of the feeder and a second position, in which the separating knife does not interrupt the flow of articles between the first end of the storage tube and the outlet of the feeder.

8. The apparatus of claim 1 wherein the second device to move the storage tube comprises a pivot driving for pivoting the first end of the storage tube.

9. The apparatus of claim 8 further comprising a spring for constraining the storage tube radially outward to a position in which the first end of the storage tube is substantially the same distance to the first axis of rotation as the outlet of the discharger.

10. The apparatus of claim 9 further comprising stops to limit the position of the storage tube.

11. The apparatus of claim 10 wherein the stops extend alongside the storage tube when the storage tube is positioned in the first position.

12. The apparatus of claim 11 wherein the stops are wedges.

13. The apparatus of claim 8 wherein the pivot driving comprises a vertically disposed pneumatic cylinder which moves a drive arm via a lever.

14. The apparatus of claim 13 wherein the drive arm has a freely turning roller which is adapted to the shape of the storage tube.

15. The apparatus of claim 1 further comprising a guiding defining a path for a flow of articles, the guiding connected to the inlet of the discharger, the guiding having a movable support for the articles delivered by the storage tube, the movable support allowing a first flow of articles to catch up with a second flow of articles in order to obtain a continuous flow of discharged articles, which support can subsequently be removed from the flow path of the articles defined by the guiding.

16. The apparatus of claim 1 wherein the first device to rotate the table comprises a pushing member mounted to the table, a first reciprocally drivable element movable between a first position and a second position, the first reciprocally drivable element engaging the pushing member in the first position to prevent rotation of the table, the first reciprocally drivable element not engaging a pushing member in the second position and therefore allowing the table to rotate.

17. An apparatus to maintain a continuous supply of articles to a discharger so as to prevent an interruption in the stream of articles discharged from the discharger, the apparatus comprising:

a feeder to feed articles, the feeder having an outlet from which articles are delivered;

a table, the table mounted for rotation about a first axis between a first position and a second position, a first storage tube to store a first supply of articles, the first storage tube connected to the table at a first distance from the first axis, the first storage tube having a first end and a second end, the first storage tube connected to the table so that the first end of the first storage tube may be pivoted into proximity with the outlet of the feeder when the table is rotated into a first position and the feeder may then feed articles into the first storage tube, a second storage tube to store a second supply of articles, the second storage tube connected to the table at a second distance from the first axis, the second distance of the second storage tube being equal to the first distance of the first storage tube, the second storage tube having a first end and a second end, the second storage tube connected to the table so that the first end of the second storage tube may be pivoted into proximity with the outlet of the feeder when the table is rotated into a second position and the feeder may then feed articles into the second storage tube;

a discharger to discharge articles, the discharger having an inlet to receive articles to be discharged, the inlet of the discharger being positioned coaxial to the first axis of rotation, the inlet further being positioned so that the first end of the first storage tube may be pivoted into proximity with the inlet of the discharger and the first supply of articles may be fed to the discharger when the table is rotated into either the first position or the second position and so that the first end of the second storage tube may be pivoted into proximity with the inlet of the discharger and the second supply of articles may be fed to the discharger when the table is rotated into either the first position or the second position; and a controller to control the positioning of the first end of the first tube and the first end of the second tube and the rotation of the table.

18. The device of claim 17 wherein the controller controls the positioning of the first end of the first storage tube and the first end of the second storage tube so that when the first storage tube is filled with the first store of articles from the feeder and the second storage tube has emptied the second store of articles, the table is rotated and the first end of the first storage tube is pivoted into proximity with the inlet of the discharger and the first end of the second storage tube is pivoted into proximity with the outlet of the feeder.

19. The device of claim 17 further comprising a driver to rotate the table.

20. The device of claim 19 wherein the driver comprises a lever attached to the first axis of rotation, the lever having a first arm and a second arm, the lever connected to an element reciprocally movable between a first position and a second position to move the second arm between a first position and a second position, the second arm having a ratchet to engage the table when the second arm moves from the first position to the second position and thereby cause the table to rotate.

21. A method of maintaining a continuous supply of articles so as to prevent an interruption in the supply of articles to a discharger comprising the steps of:

filling a first end of a first storage device with articles from a first end of a feeder;

emptying articles from a first end of a second storage device into a first end of a discharger;

moving the first end of the second storage device from the first end of the discharger;

moving the first end of the first storage device from the first end of the feeder;

rotating the first storage device and the second storage device about a first axis;

moving the first end of the first storage device to the first end of the discharger and emptying articles from the first storage device into the inlet of the discharger; and moving the first end of the full storage device to the first end of the feeder and filling the second storage device with articles from the outlet of the feeder.

22. The method of claim 21 comprising the additional step of sensing the amount to which the first storage device is filled by the feeder and the amount to which the second storage device is emptied into the discharger.

23. The device of claim 21 wherein the first end of the first storage device moves pivotally.

24. The device of claim 21 wherein the first end of the second storage device moves pivotally.

25. An apparatus for forming a buffer store of stackable articles comprising:

a feeder having an outlet to feed articles;

a discharger having an inlet to receive articles;

a storage tube for storing a stack of articles, the storage tube connected to a table, the table rotatable about a first axis of rotation, the storage tube having a first end, the storage tube movable between a first position, in which the first end of the storage tube is connectable to the outlet of the feeder to fill the storage tube with articles fed from the feeder, and a second position, in which the first end of the storage tube is connectable to the inlet of the discharger to deliver articles from the storage tube to the discharger;

a first device to rotate the table;

a second device to move the storage tube between the first position and the second position;

a controller to control the movement of the storage tube; and a securing collar for maintaining the first end of the storage tube in connection with the inlet of the discharger.

26. The apparatus of claim 25 wherein the securing collar is movable between a first position and a second position.

27. The apparatus of claim 25 wherein the controller controls the securing collar.

28. An apparatus for forming a buffer store of stackable articles comprising:

a feeder having an outlet to feed articles;

a discharger having an inlet to receive articles;

a storage tube for storing a stack of articles, the storage tube connected to a table, the table rotatable about a first axis of rotation, the storage tube having a first end, the storage tube movable between a first position, in which the first end of the storage tube is connectable to the outlet of the feeder to fill the storage tube with articles fed from the feeder, and a second position, in which the first end of the storage tube is connectable to the inlet of the discharger to deliver articles from the storage tube to the discharger;

a first device to rotate the table;

a second device to move the storage tube between the first position and the second position;

a controller to control the movement of the storage tube; and a suspension to connect the storage tube to the table, the suspension positioned at a distance from the first axis of rotation.

29. The apparatus of claim 28 wherein the distance of the suspension from the first axis of rotation is substantially the same as the distance the outlet of the feeder is placed from the first axis of rotation.

30. An apparatus for forming a buffer store of stackable articles comprising:

a feeder having an outlet to feed articles;

a discharger having an inlet to receive articles;

a storage tube for storing a stack of articles, the storage tube connected to a table, the table rotatable about a first axis of rotation, the storage tube having a first end, the storage tube movable between a first position, in which the first end of the storage tube is connectable to the outlet of the feeder to fill the storage tube with articles fed from the feeder, and a second position, in which the first end of the storage tube is connectable to the inlet of the discharger to deliver articles from the storage tube to the discharger;

a first device to rotate the table;

a second device to move the storage tube between the first position and the second position;

a controller to control the movement of the storage tube; and a plate having a first hole forming the outlet of the feeder, and a second hole forming the inlet to the discharger.

31. The apparatus of claim 30 wherein the first end of the storage tube is located at a distance from the plate such than an article in the storage tube will slide along the plate and remain in the storage tube during the movement of the storage tube.

32. The apparatus of claim 31 wherein the plate is substantially smooth.

33. An apparatus for forming a buffer store of stackable articles comprising:

a feeder having an outlet to feed articles;

a discharger having an inlet to receive articles;

a storage tube for storing a stack of articles, the storage tube connected to a table, the table rotatable about a first axis of rotation, the storage tube having a first end, the storage tube movable between a first position, in which the first end of the storage tube is connectable to the outlet of the feeder to fill the storage tube with articles fed from the feeder, and a second position, in which the first end of the storage tube is connectable to the inlet of the discharger to deliver articles from the storage tube to the discharger;

a first device to rotate the table;

a second device to move the storage tube between the first position and the second position;

a controller to control the movement of the storage tube; and a separating knife movable between a first position in which the separating knife interrupts the flow of articles between the first end of the storage tube and the outlet of the feeder, and a second position in which the separating knife does not interrupt the flow of articles between the first end of the storage tube and the outlet of the feeder.

34. The apparatus of claim 33 wherein the movement of the separating knife is controlled by the controller so as to interrupt the flow of articles after the storage tube has been filled to a desired amount.

35. The apparatus of claim 34 further comprising a sensor to sense articles, the sensor placed along the path of the flow of articles, the sensor being connected to the controller.

36. The apparatus of claim 35 further comprising a device to deliver articles, the device being connected to the feeder, the delivery device further being connected to the controller.

37. An apparatus for forming a buffer store of stackable articles comprising:

a feeder having an outlet to feed articles;

a discharger having an inlet to receive articles;

a storage tube for storing a stack of articles, the storage tube connected to a table, the table rotatable about a first axis of rotation, the storage tube having a first end, the storage tube movable between a first position, in which the first end of the storage tube is connectable to the outlet of the feeder to fill the storage tube with articles fed from the feeder, and a second position, in which the first end of the storage tube is connectable to the inlet of the discharger to deliver articles from the storage tube to the discharger;

a first device to rotate the table;

a second device to move the storage tube between the first position and the second position;

a controller to control the movement of the storage tube; and a guiding defining path for a flow of articles, the guiding connected to the inlet of the discharger, the guiding having a movable support for the articles delivered by the storage tube, the movable support allowing a first flow of articles to catch up with a second flow of articles in order to obtain a continuous flow of discharged articles, which support can subsequently be removed from the flow path of the articles defined by the guiding.

38. The apparatus of claim 37 wherein the guiding is arcuate and the movable support is carried by an arm which is mounted for pivoting concentrically to the guiding tube.

39. An apparatus for forming a buffer store of stackable articles comprising:

a feeder having an outlet to feed articles;

a discharger having an inlet to receive articles;

a storage tube for storing a stack of articles; the storage tube connected to a table, the table rotatable about a first axis of rotation, the storage tube having a first end, the storage tube movable between a first position, in which the first end of the storage tube is connectable to the outlet of the feeder to fill the storage tube with articles fed from the feeder, and a second position, in which the first end of the storage tube is connectable to the inlet of the discharger to deliver articles from the storage tube to the discharger;

a first device to rotate the table;

a second device to move the storage tube between the first position and the second position; and a controller to control the movement of the storage tube;

wherein the first device to rotate the table comprises a pushing member mounted to the table and a first reciprocally drivable element movable between a first position and a second position, the first reciprocally drivable element engaging the pushing member in the first position to prevent rotation of the table, the first reciprocally drivable element not engaging the pushing member in the second position thereby allowing the table to rotate.

* * * * *